US007775995B2

(12) United States Patent
Voss

(10) Patent No.: US 7,775,995 B2
(45) Date of Patent: Aug. 17, 2010

(54) DEVICE FOR THE GENERATION OF SHOCK WAVES UTILIZING A THYRISTOR

(75) Inventor: Axel Voss, Kreuzlingen (CH)

(73) Assignee: Tissue Regeneration Technologies LLC, Marletta, GA (US)

( * ) Notice: Subject to any disclaimer, the term of this patent is extended or adjusted under 35 U.S.C. 154(b) by 782 days.

(21) Appl. No.: 11/699,863

(22) Filed: Jan. 30, 2007

(65) Prior Publication Data

US 2007/0232964 A1 Oct. 4, 2007

Related U.S. Application Data

(60) Provisional application No. 60/763,812, filed on Jan. 31, 2006.

(51) Int. Cl.
*A61H 1/00* (2006.01)
*A61H 1/02* (2006.01)
*A61H 5/00* (2006.01)

(52) U.S. Cl. ..... 601/2; 601/4

(58) Field of Classification Search ..... 601/2, 601/4

See application file for complete search history.

(56) References Cited

U.S. PATENT DOCUMENTS

| | | | | |
|---|---|---|---|---|
| 5,014,102 | A * | 5/1991 | Adler | 257/139 |
| 5,233,980 | A * | 8/1993 | Mestas et al. | 601/4 |
| 6,217,531 | B1 * | 4/2001 | Reitmajer | 601/4 |
| 6,231,529 | B1 * | 5/2001 | Bauer et al. | 601/4 |

FOREIGN PATENT DOCUMENTS

DE 4420832 A1 1/1995

* cited by examiner

*Primary Examiner*—Brian Casler
*Assistant Examiner*—James Kish
(74) *Attorney, Agent, or Firm*—David L. King

(57) ABSTRACT

The invention relates to a device for the generation of shock waves for medical therapy, having a shock source, an energy storage and a switch, wherein the energy storage is a capacitor with a high capacity.

1 Claim, 1 Drawing Sheet

DEVICE FOR THE GENERATION OF SHOCK WAVES UTILIZING A THYRISTOR

STATEMENT OF RELATED CASES

The instant application claims the benefit of U.S. Provisional Application No. 60/763,812, filed Jan. 31, 2006.

FIELD OF THE INVENTION

The invention relates to shock wave generators with an improved electronic circuit.

BACKGROUND

Shock wave generators are used in numerous medical fields. The most commonly known field is the therapeutic and cosmetic application in the treatment, for example, of calculous diseases (e.g. urolithiasis, cholelithiasis) and the treatment of scars in human and veterinary medicine.

New fields of application involve dental treatment, the treatment of arthrosis, the removal of calcerous deposits (e.g. tendinosis calcarea), the treatment of chronic tennis or golfer elbows (so called radial or ulnar epicondylopathy), of chronic discomfort of the shoulder tendons (so called enthesopathy of the rotator cuff), and of chronic irritation of the Achilles tendon (so called achillodynia).

Furthermore, the generation of shock waves is also used in the therapy of osteoporosis, periodontosis, non-healing bone fractures (so called pseudoarthrosis), bone necrosis, and similar diseases. More recent research studies also investigate the application in stem cell therapy.

Furthermore, the shock wave generation can also be used to exert mechanical stress, e.g. in the form of shearing forces, on cells, whereby their apoptosis is initiated. This occurs for example by means of an initiation of the 'death receptor pathway' and/or the cytochrome c-pathway and/or a caspase cascade.

The term apoptosis is understood to mean the initiation of a genetically controlled program which leads to the 'cell suicide' of individual cells in the tissue structure. As a result, the cells concerned and their organoids shrink and disintegrate into fragments, the so-called apoptotic bodies. These are phagocytized afterwards by macrophages and/or adjoining cells. Consequently, the apoptosis is a non-necrotic cell death without inflammatory reactions.

Therefore, the application of shock waves is advantageous in all cases where the treatment of diseases with an abased rate of apoptosis is involved, e.g. the treatment of tumours or viral diseases.

Furthermore, the shock wave generation can be applied advantageously in the treatment of necrotically changed areas and structures in muscle tissue, especially in the tissue of the cardiac muscle, in the stimulation of cartilage assembly in arthritic joint diseases, in the initiation of the differentiation of embryonic or adult stem cells in vivo and in vitro in relation to the surrounding cell structure, in the treatment of tissue weakness, especially of cellulitis, and in the degradation of adipose cells, as well as the activation of growth factors, especially TGF-[beta].

The generation of shock waves can also be used for avoiding the formation and/or expansion of edema, for degradation of edema, for the treatment of ischaemia, rheumatism, illnesses of joints, jaw bone (periodontosis), cardiologic diseases and heart attacks, pareses (paralyses), neuritis, paraplegia, arthrosis, arthritis, for the prevention of scar formation, for the treatment of scar formation and nerve scarring, respectively, for the treatment of achillobursitis and other bone necroses.

A further application relates to the treatment of spinal cord and nerve lesions, for example spinal cord lesions accompanied by the formation of edema.

Shock waves are also applicable for the treatment of scarred tendon and ligament tissue as well as poorly healing open wounds.

Such poorly healing open wounds and boils are called ulcus or also ulceration. They are a destruction of the surface by tissue disintegration at the dermis and/or mucosa. Depending on what tissue fractions are affected, surfacial lesions are called exfoliation (only epidermis affected) or excoriation (epidermis and corium affected).

Open wounds that can be treated with shock waves comprise especially chronic leg ulcers, hypertensive ischaemic ulcers, varicose ulcers or ulcus terebrans due to a subsequently caused improved healing process.

Furthermore, shock waves are suitable for the stimulation of cell proliferation and the differentiation of stem cells.

Typical shock wave generators have a basis device, to which a therapy head can be connected. The therapy head comprises an integrated reflector with a shock wave source and a coupling membrane.

During the use of shock waves for the destruction of concrements, a shock wave energy of approximately 1 to 5 J is normally applied. For this purpose, a capacitor with a capacity of approximately 10 to 100 nF is charged to a voltage of approximately 15 to 30 kV and then unloaded by way of a spark discharge section.

The spark discharge section consists of two electrodes that are essentially pointed and whose tips are arranged at a distance of approx. 1.5 to 3 mm from one another. Normally, the distance is approx. 1 mm per 10 kV charge voltage.

The shock wave generators known up to the present are disadvantageous in that the switches for such high voltages are sophisticated and expensive and are, in addition, often unreliable. It is therefore that task of this invention to provide a shock wave generator which can be operated with less complicated and more reliable switches.

This task is solved by a shock wave generator according to the present invention.

SUMMARY OF THE INVENTION

A shock wave generator according to the present invention has a shock source, an energy storage and a switch, wherein the energy storage is a capacitor with a capacity of between approx. 1 nF and approx. 500 mF.

With an increase of the capacity of the capacitor, the voltage to which the capacitor is charged can be decreased at the same power level stored in the capacitor. In a preferred embodiment, the capacity of the capacitor is larger than approx. 100 nF.

The low voltage of the capacitor allows the use of a simple, inexpensive and reliable semiconductor switch to switch the discharge operation of the capacitor.

In a preferred embodiment, the switch is a thyristor, preferably a MOSFET thyristor. In same way, the use of a gate-turn-off thyristor is conceivable.

In a further preferred embodiment, the capacitor can be charged to a voltage of approx. 500 V to approx. 5000 V. MOSFET thyristors are particularly suitable for this voltage range.

In a further preferred embodiment, the shock source is a spark discharge section. In a particularly preferred embodiment, the spark discharge section has two essentially pointed electrodes whose tips are arranged at a distance of approx. 0.1 mm to approx. 1 mm from each other.

BRIEF DESCRIPTION OF THE DRAWINGS

The invention is explained as follows in greater detail on the basis of the drawings. These drawings show the following.

DETAILED DESCRIPTION OF THE INVENTION

Figure 1:
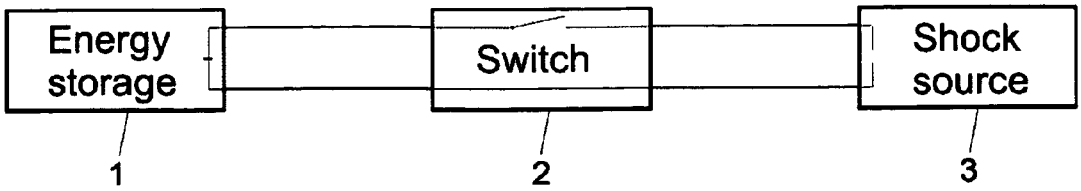
FIG. 1 shows a schematic illustration of the device according to the invention for the generation of shock waves.

The illustration of FIG. 1 shows the schematic configuration of a shock wave generator according to the invention. A capacitor with a capacity of 10 μF is used as energy storage (1). If this capacitor is charged to 1000 V, the energy stored in it is $E=\frac{1}{2}CU^2=5$ J. For the shock wave generation, subsequently, an amount of energy is available which is comparable to that as known from the state of the art.

An electronic circuit with a MOSFET thyristor is used as a switch (2) which connects the energy storage (1) with the shock source (3). Such a thyristor makes it possible to reliably switch currents arising during the generation of the shock wave.

The shock source (3) is a spark discharge section arranged in a reflector. A preferred embodiment of such a wave source (3) is shown in FIG. 2.

Figure 2:
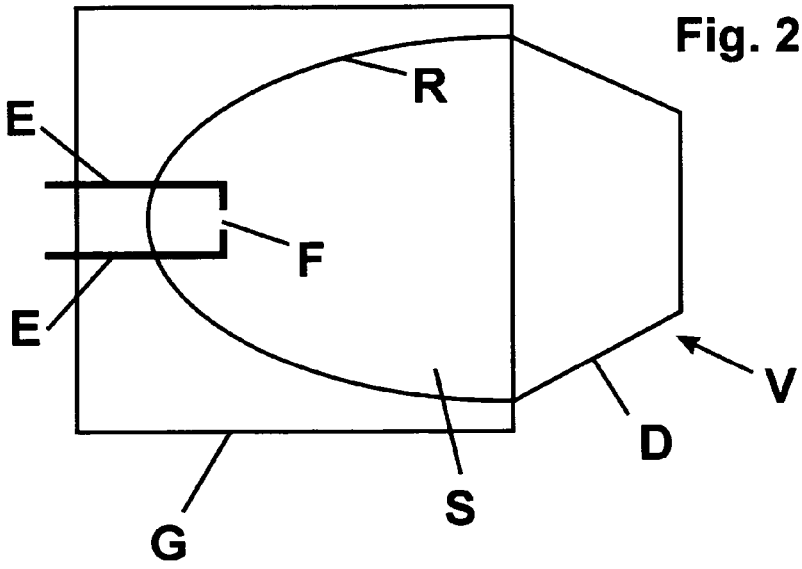
FIG. 2 shows a schematic illustration of the shock source used in FIG. 1.

FIG. 2 shows a therapy head (V) for the shock wave treatment, which contains an electro-hydraulic shock source. The therapy head (V) consists of a housing (G), having a reflector (R), which is formed by a cavity that is open in the distal direction. The form of the reflector (R) is essentially rotation-symmetrical and corresponds to a section of an ellipsoid. The open side of the cavity is closed off with a closure cap (D), which is manufactured from a material, e.g., silicon that guarantees a good coupling of the shock waves to that part of the body that is to be treated. The closed-off cavity created in this way is at least partially filled with a liquid medium, water for example.

On the proximal side of the housing (G) the two electrodes (E), between whose tips the spark discharge section (F) is located, are solidly joined to the housing (G) in such a way that the spark discharge section (F) comes to rest on or near the primary focus of the reflector ellipsoid. The distance of the electrode tips amounts to approx. 0.5 mm.

The electro-hydraulic shock source has two electrodes (E), between whose tips the spark discharge section is (F) located. The cavity formed by the housing (G) and the closure cap (D) is filled in water with a colloidal suspension (S) of conductive particles such as aluminium. These conductive particles enable a generation of the spark discharge and, thus, of the shock wave at low voltages. In addition, and if the distance of the electrode tips has increased due to wear, shock waves can still be generated reliably.

The conductance of the medium can be set by way of the concentration of the conductive particles between 1 μS and 1000 μS.

The therapy head (V) can be mounted in a therapy head receptacle (not shown) so that the electrodes (E) of the device (V) can come into electrical contact with the activation electronic system (not shown).

REFERENCE SYMBOL LIST

1 Energy storage
2 Switch
3 Shock source
D Closure cap
E Electrode
F Spark discharge section
G Housing
R Reflector
S Colloidal suspension
V Therapy head for shock wave generation

I claim:

1. A device for the generation of shock waves for the medical therapy, having an electro-hydraulic shock source, an energy storage and a switch, wherein the energy storage is a capacitor with a capacitance of between 500 nF and larger than 100 nF and the switch is a semiconductor MOSFET thyristor switch, and the electro-hydraulic shock source is a spark discharge section and the spark discharge section having two essentially pointed electrodes whose tips are arranged at a distance of 0.1 mm to 1 mm from one another, which discharges when the capacitor is charged to a voltage of between 500 V to 5000 V.

* * * * *